US007384117B2

(12) United States Patent
Shoki et al.

(10) Patent No.: US 7,384,117 B2
(45) Date of Patent: Jun. 10, 2008

(54) INK JET PRINTER

(75) Inventors: Mikio Shoki, Daito (JP); Ryuji Aoki, Daito (JP); Toshiyuki Nakanishi, Daito (JP); Yuichiro Itoh, Daito (JP); Makoto Tsujinishi, Daito (JP)

(73) Assignee: Funai Electric Co., Ltd., Daito-shi (JP)

( * ) Notice: Subject to any disclaimer, the term of this patent is extended or adjusted under 35 U.S.C. 154(b) by 253 days.

(21) Appl. No.: 11/262,981

(22) Filed: Nov. 1, 2005

(65) Prior Publication Data

US 2006/0092208 A1 May 4, 2006

(30) Foreign Application Priority Data

Nov. 1, 2004 (JP) ..... 2004-318515

(51) Int. Cl.
*B41J 29/393* (2006.01)

(52) U.S. Cl. ..... 347/19

(58) Field of Classification Search ..... 347/19, 347/67, 104, 105
See application file for complete search history.

(56) References Cited

U.S. PATENT DOCUMENTS 6,390,588 B1 * 5/2002 Ikeda ..... 347/19
6,659,578 B2 * 12/2003 Gudaitis et al. ..... 347/3
2003/0202029 A1 * 10/2003 Bronswijk et al. ..... 347/19

FOREIGN PATENT DOCUMENTS

| | | |
|---|---|---|
| JP | 2001-527472 | 12/2001 |
| JP | 2003-229995 | 8/2003 |
| WO | WO 98/26932 | 6/1998 |

* cited by examiner

*Primary Examiner*—Lamson Nguyen
*Assistant Examiner*—Justin Seo
(74) *Attorney, Agent, or Firm*—Crowell & Moring LLP

(57) ABSTRACT

In an ink jet printer using an ink cartridge having an ink tank for storing ink therein and a recording head for ejecting the ink stored in the ink tank as ink drops and forming an image on a recording paper sheet, the detection accuracy of a displacement detection sensor for detecting a displacement of printing position is improved while reducing manufacturing costs of the displacement detection sensor. The displacement detection sensor is comprised of a light emitting device for emitting diffused light, a first lens for focusing the light emitted from the light emitting device on a recording paper sheet, a second lens for focusing the light reflected by the recording paper sheet and a light receiving device for receiving the light focused by the second lens. By focusing the diffused light emitted from the light emitting device by the first lens, the diameter of a beam spot projected on the recording paper sheet is made smaller than a longitudinal dimension and a width dimension of each component forming a displacement detection pattern.

3 Claims, 5 Drawing Sheets

INK JET PRINTER

BACKGROUND OF THE INVENTION

1. Field of the Invention

The present invention relates to an ink jet printer having a function of automatically correcting displacement of printing position occurring when an ink cartridge is mounted.

2. Description of the related Art

Conventionally, an ink jet printer having a function of automatically correcting displacement of printing position by forming a predetermined displacement detection pattern on a recording paper sheet by a recording head after an ink cartridge is mounted, reading the pattern by a displacement detection sensor and adjusting control timing of the recording head on the basis of the result has become commercially practical.

FIG. 6 shows a configuration of the displacement detection sensor for detecting the displacement of printing position used in the conventional ink jet printer. The displacement detection sensor 104 is comprised of a light emitting device 141 for emitting light on a recording paper sheet 2 at a predetermined radiation angle, a light receiving device 144 for receiving the light emitted from the light emitting device 141 and reflected by the recording paper sheet 2, a sensor housing 150 for accommodating these components and so on.

FIG. 7A shows a displacement detection pattern formed on the recording paper sheet 2 and a beam spot of light projected on the recording paper sheet 2 from the light emitting device 141. FIG. 7B shows an electric signal output from the light receiving device 144. Recently, in the ink jet printers, it is required to increase the detection accuracy of the displacement of printing position by the displacement detection sensor 104 following to further development of high resolution, so that the displacement detection pattern 80 shown in FIG. 7A comes in predisposed to be miniaturized. In order to detect such a miniaturized displacement detection pattern 80 with a high degree of accuracy, it is desirable to set the diameter of a beam spot 170 irradiated to the recording paper sheet 2 smaller corresponding to the miniaturization of the displacement detection pattern 80. However, in the configuration of the conventional displacement detection sensor 104 shown in FIG. 6, the diameter of the beam spot 170 depends on directional characteristics of the light emitting device 141 and a distance between the light emitting device 141 and the recording paper sheet 2, so that the designer of the ink jet printer cannot arbitrarily decide the diameter of the beam spot 170. As shown in FIG. 7A, the diameter of the beam spot 170 may become larger than a longitudinal dimension L and a width dimension W of the displacement detection pattern 80.

In such a case, as shown in FIG. 7B, an electric signal 190 having a waveform with small amplitude (small S/N) is output from the light receiving device 144. Thus, the detection error of the displacement detection sensor 104 becomes large and therefore, minute displacement of printing position cannot be corrected to respond to high-resolution printing satisfactory to the user.

Thus, there is the conventional ink jet printer, for example, having a configuration that a slit for detecting an edge of the displacement detection pattern is provided on a light receiving portion of the light receiving device so that the edge of the displacement detection pattern can be detected at the side of the light emitting device even when the diffused light is emitted from the light emitting device to ensure detection accuracy of the displacement detection sensor. However, such a light receiving device having the slit used in the printer contributes to an increase in manufacturing costs of the overall printer due to its high cost price.

Besides Japanese Laid-Open Patent Publication No. 2001-527472 discloses a displacement detection sensor in which a Fresnel lens provided at a side of a light emitting device and an aspherical lens provided at a side a light receiving device are formed in an integral manner. Furthermore, Japanese Laid-Open Patent Publication No. 2003-229995 discloses a displacement detection sensor having a plurality of light emitting devices for emitting lights of different colors and a lens assembly with a plurality of lenses for deflecting and focusing the light emitted from each of the light emitting devices at a predetermined position on a recording paper sheet. However, since a plurality of lenses must be integrally formed with a high degree of accuracy in both the displacement detection sensors, manufacturing costs become higher and thus, these sensors are not suited to printers for consumers requiring low price. Furthermore, since the Fresnel lens disclosed in Japanese Laid-Open Patent Publication No. 2001-527472 diffuses light in the direction other than the displacement detection pattern, projection efficiency of the light to the recording paper sheet is deteriorated, thereby decreasing the S/N of the signal output from the light receiving device.

SUMMARY OF THE INVENTION

In order to solve the above-mentioned problems, an object of the present invention is to provide an ink jet printer capable of improving detection accuracy of a displacement detection sensor while reducing manufacturing costs of the displacement detection sensor.

To achieve the above-mentioned object, an ink jet printer in accordance with an aspect of the present invention comprises: an ink tank for storing ink therein and a recording head for ejecting the ink stored in the ink tank as ink drops and forming an image on a recording paper sheet; a carriage on which the ink cartridge is attached; a driving mechanism for driving the carriage so as to move reciprocally in a direction substantially perpendicular to a direction for conveying the recording paper sheet; a displacement detection sensor for reading a predetermined displacement detection pattern formed on the recording paper sheet by the recording head; and a displacement correction control means for correcting a displacement of printing position by controlling ejection timing of the ink drops from the recording head based on a result of reading the displacement detection pattern by the displacement detection sensor.

The displacement detection sensor has a light emitting device for emitting diffused light, a light receiving device for receiving the light emitted from the light emitting device and reflected by the recording paper sheet, converting the received light into an electric signal and outputting the electric signal to the displacement correction control means, a first lens for focusing the diffused light emitted from the light emitting device on the recording paper sheet and a second lens for focusing the light reflected by the recording paper sheet on the light receiving device. In the displacement detection sensor, the diffused light emitted from the light emitting device is focused by the first lens and reflected by the recording paper sheet, and then the diffused light is focused on the light receiving device by the second lens. In this manner, by making the amplitude of an electric signal output from the light receiving device larger, detection accuracy of the displacement detection sensor can be improved.

According to such a configuration, since the diffused light emitted from the light emitting device is focused by the first lens, the diameter of the beam spot projected on the recording paper sheet can be made smaller and the beam spot can be made brighter. Furthermore, since the light reflected by the recording paper sheet is focused on the light receiving device by the second lens, the light receiving efficiency of the light receiving device can be improved. Thereby, the amplitude of the electric signal output from the light receiving device can be made larger and the detection accuracy of the displacement detection sensor can be improved so as to adequately address high-resolution printing satisfactory to the user. Still furthermore, since the detection accuracy of the displacement detection sensor is improved by using inexpensive lenses instead of using the expensive light receiving device with a slit, manufacturing costs of the printer can be reduced. Still furthermore, since light is focused by the first lens and the second lens, the ratio of the light which reaches to the light receiving device against the light output from light emitting device becomes higher. Thus, the inexpensive low-powered light emitting device can be used, resulting in further cost reduction.

DETAILED DESCRIPTION OF THE EMBODIMENT

An ink jet printer in accordance with an embodiment of the present invention is described with reference to drawings.

Figure 1:
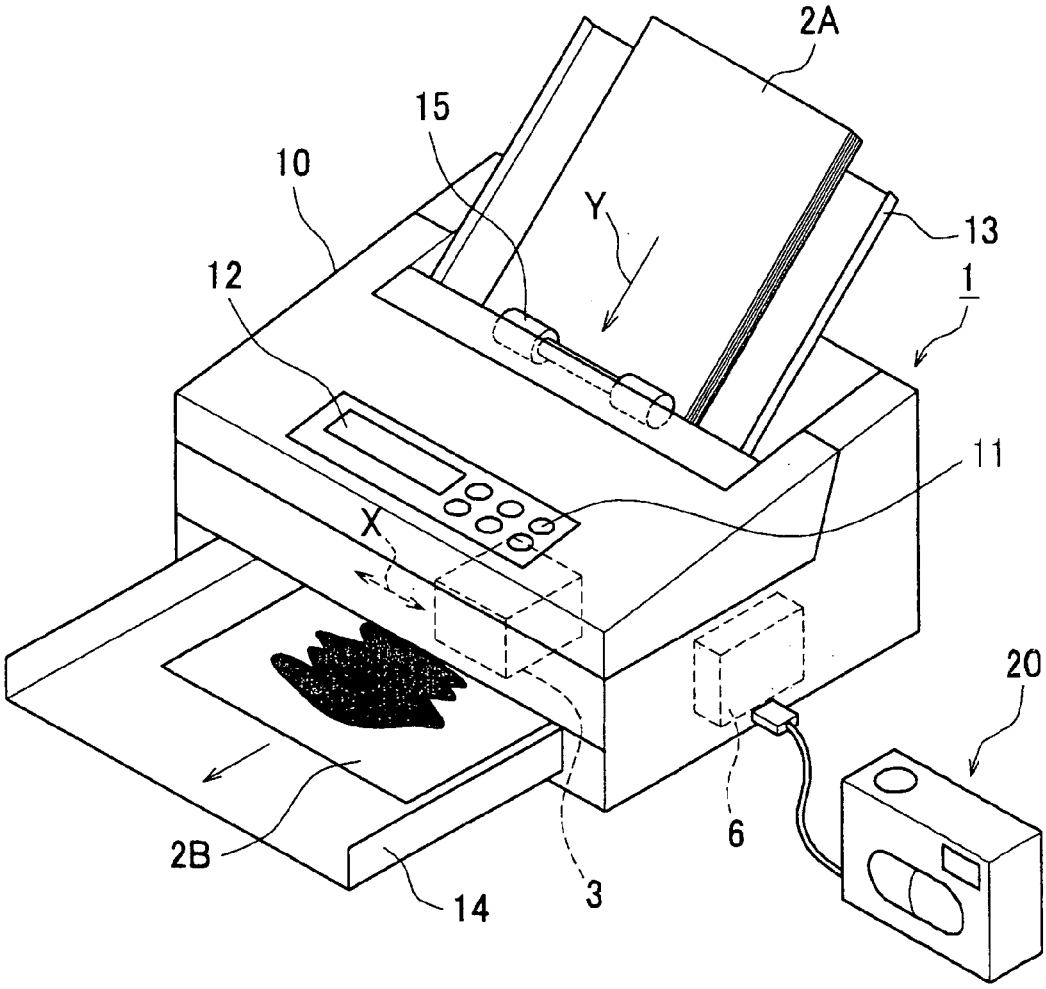
FIG. 1 is a perspective view showing a configuration of an ink jet printer in accordance with an embodiment of the present invention.

FIG. 1 shows a configuration of an ink jet printer 1. An operation switch 11 used for selecting a function among various functions of the ink jet printer 1 or inputting a print size, a number of sheets to be printed and so on, and a display device such as a liquid crystal display (LCD) for checking the selected function and input data and displaying an operation state of the ink jet printer 1 are provided on a top face of a housing 10 of the ink jet printer 1. A paper sheet feed tray 13 for holding recording paper sheets 2A to be printed is provided in an upper rear portion of the housing 10, and a paper sheet exit tray 14 for holding printed recording paper sheets 2B exit from the printer 1 is provided in a lower front portion of the housing 10.

A control circuit 6 for controlling entire of the ink jet printer 1 is provided in the housing 10. The control circuit 6 has a function of forming an image on the recording paper sheet 2A on the basis of image data transmitted from a personal computer (not shown) or the like as well as a function of decompressing JPEG compressed data transmitted from a digital camera 20 or the like.

A paper conveying mechanism 15 for conveying the recording paper sheet 2A from the paper sheet feed tray 13 to a predetermined print position in a sub-scanning direction (Y direction) and exiting the printed recording paper sheet 2B to the paper sheet exit tray 14, and a carriage 3 for forming an image on the recording paper sheet 2A by discharging ink drops toward the recording paper sheet 2A while reciprocating motion in a main-scanning direction (X direction) perpendicular to the sub-scanning direction (Y direction) are provided in the housing 10.

Figure 2:
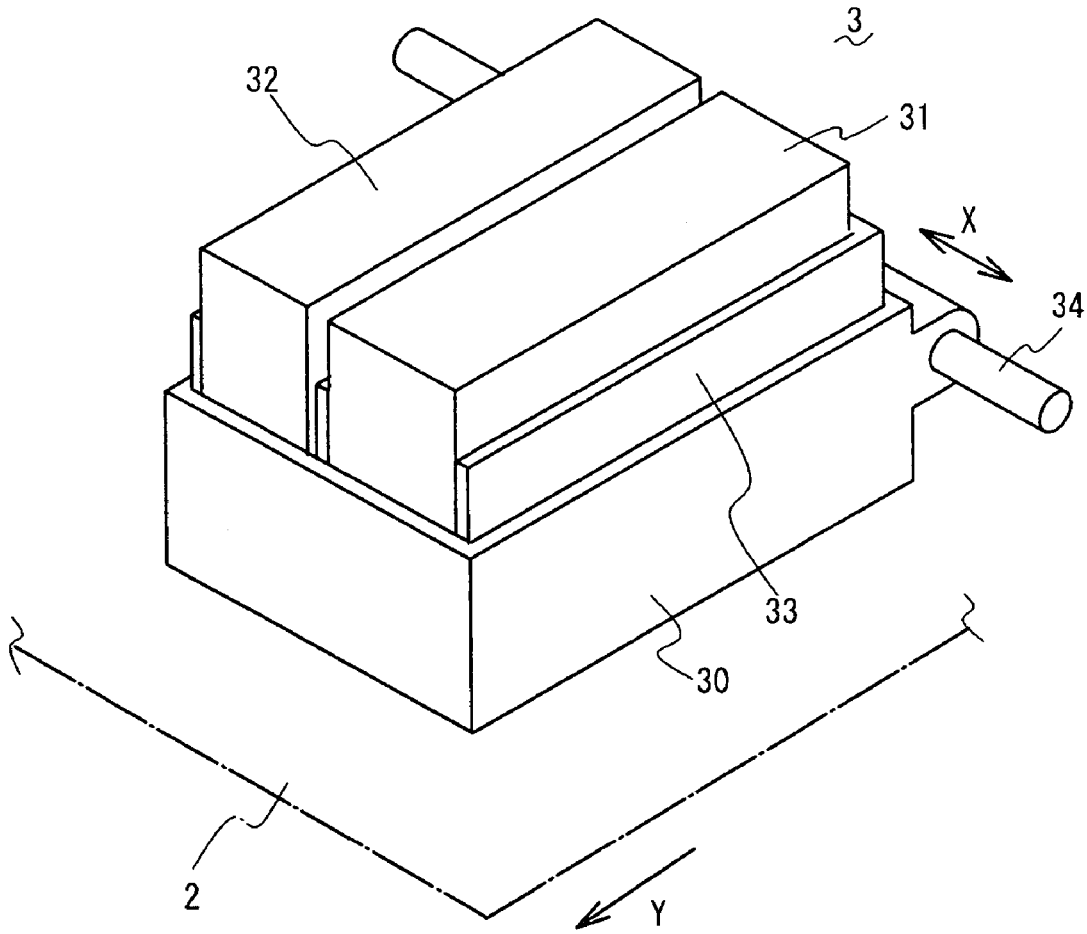
FIG. 2 is a perspective view showing a carriage of the above-mentioned printer.

FIG. 2 is a perspective view showing a configuration of the carriage 3. The carriage 3 has a carriage main body 30, a black ink cartridge 31, a color ink cartridge 32 and a cradle (cartridge supporting member) 33 for detachably supporting the ink cartridges 31 and 32, and is supported by a shaft 34 located parallel to the recording paper sheet 2 to be conveyed so as to move reciprocally in the main-scanning direction. The carriage main body 30 is driven by a driving mechanism (not shown) comprised of a motor, a pulley, a belt, etc. and reciprocated.

Since the cradle 33 is configured to detachably support the ink cartridges 31 and 32 (refer to FIG. 3), the positional relationship between the ink cartridges 31 and 32 attached by the user and the cradle 33 (alignment of the ink cartridges 31 and 32) varies slightly every time they are attached. Following to this fact, the positional relationship of a recording head 36 relative to the recording paper sheet 2 changes (refer to FIG. 3), thereby possibly causing a displacement of printing position. Thus, the ink jet printer 1 is provided with a displacement detection sensor 4 (refer to FIG. 3), and by using the displacement detection sensor 4, detects the displacement of printing position if needed, and automatically corrects the displacement of printing position, for example, after the ink cartridge 31 or 32 is replaced. The detection of the displacement of printing position is performed by that a predetermined displacement detection pattern is formed on the recording paper sheet 2 by the recording head 36 while allowing the carriage 3 to be scanned in the horizontal scanning direction, and then the displacement detection pattern is read by the displacement detection sensor 4. The correction of the displacement of printing position is performed by that a control circuit 6 controls ejecting timing of ink drops from the recording head 36 provided at each of the ink cartridges 31 and 32 on the basis of the result of reading the displacement detection pattern by the displacement detection sensor 4.

Figure 3:
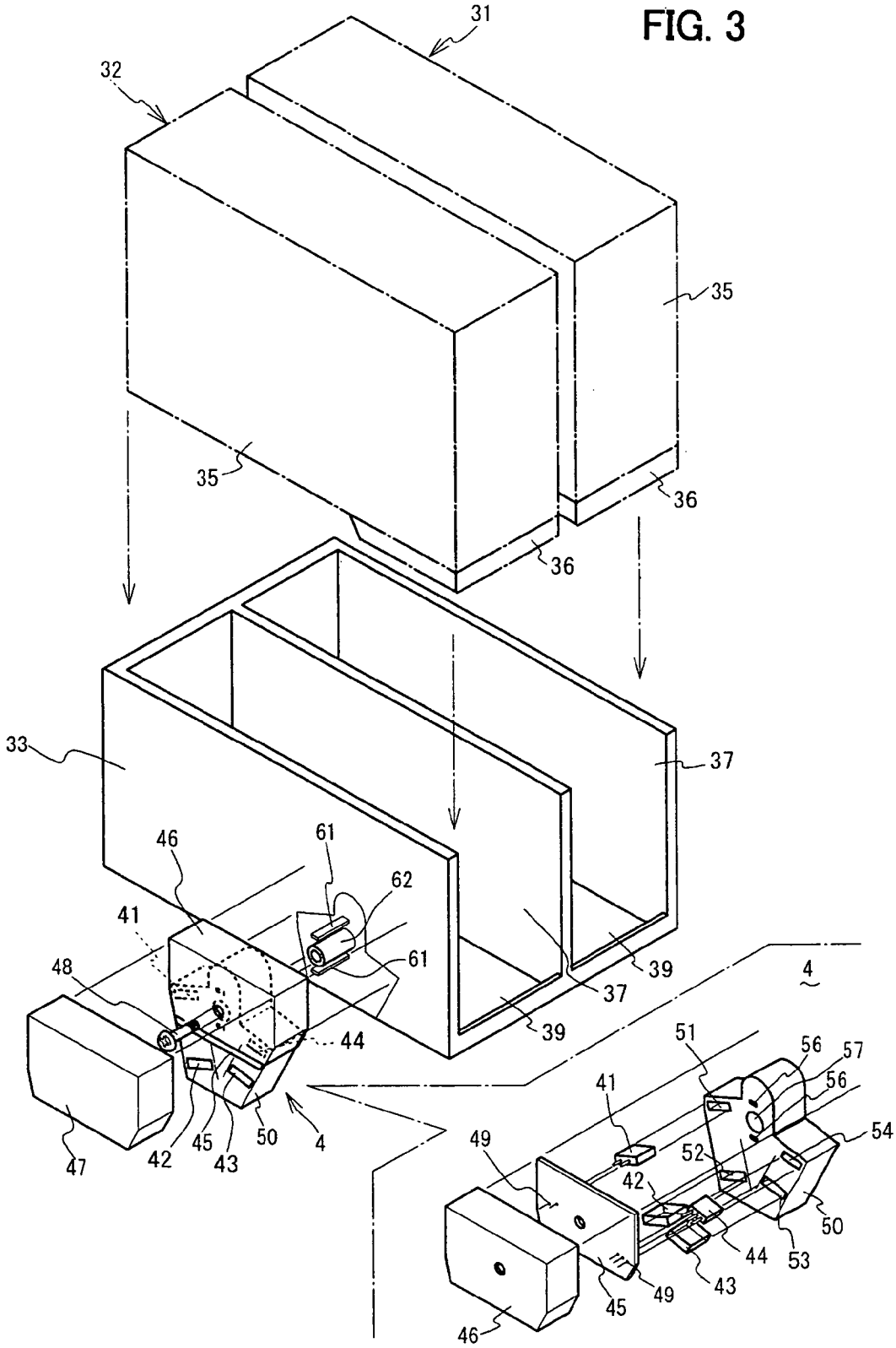
FIG. 3 is a perspective view showing an assembly configuration of an ink cartridge, a cradle and a displacement detection sensor of the above-mentioned printer.

FIG. 3 shows a configuration of the ink cartridges 31 and 32, the cradle 33 and the displacement detection sensor 4. The ink cartridges 31 and 32 each has an ink tank 35 for storing ink therein and the recording head 36 for ejecting the ink stored in the ink tank 35 as ink drops and forming an image on the recording paper sheet 2. The cradle 33 formed by resin molding has cartridge attachment portions 37 on which the ink cartridges 31 and 32 are attached. An opening 39 through which the recording head 36 of each ink cartridge 31 or 32 is penetrated to the side of the recording paper sheet 2 (the underside in this figure) is provided at each cartridge attachment portion 37 corresponding to the recording head 36. A sensor housing 50 for accommodating components of the displacement detection sensor 4 is attached to a side face of a main body of the cradle 33 via a screw 48. A pair of protrusions 61 for positioning the sensor housing 50 and a cylindrical part 62 to which the screw 48 is screwed are formed on the side face of the cradle 33.

The displacement detection sensor 4 has a light emitting device 41 for emitting a diffused light, a first lens 42 for focusing the diffused light emitted from the light emitting device 41 on the recording paper sheet 2, a second lens 43 for focusing the light reflected by the recording paper sheet 2, a light receiving device 44 for receiving the light passed through the second lens 43, the sensor housing 50 for holding the above-mentioned components, a circuit board 45 to which terminals of the light emitting device 41 and the light receiving device 44 are connected, a cover member 46 formed by resin molding for covering the circuit board 45 and an antistatic metal plate 47 attached to the outside of the cover member 46. The sensor housing 50 is provided with recessed parts 51, 52, 53 and 54 for fitting the light emitting device 41, the first lens 42, the second lens 43 and the light receiving device 44, respectively, and slits 56 and a hole 57 corresponding to the protrusions 61 and the cylindrical part 62, respectively.

Figure 4:
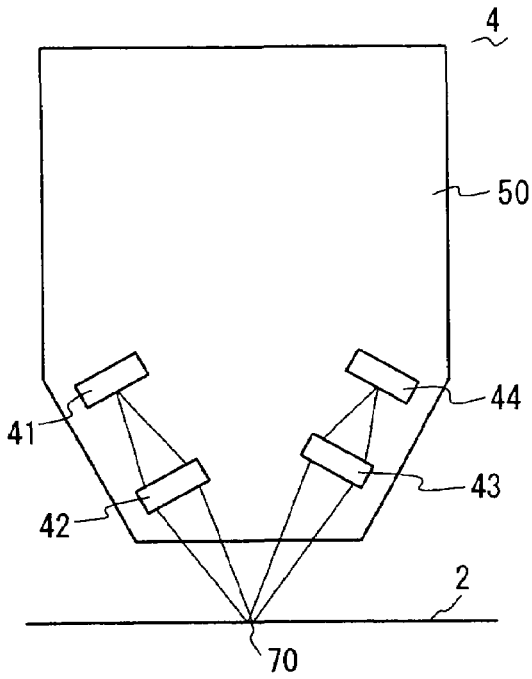
FIG. 4 is a view showing a state where a displacement of printing position is detected by the displacement detection sensor.
Figure 5A:
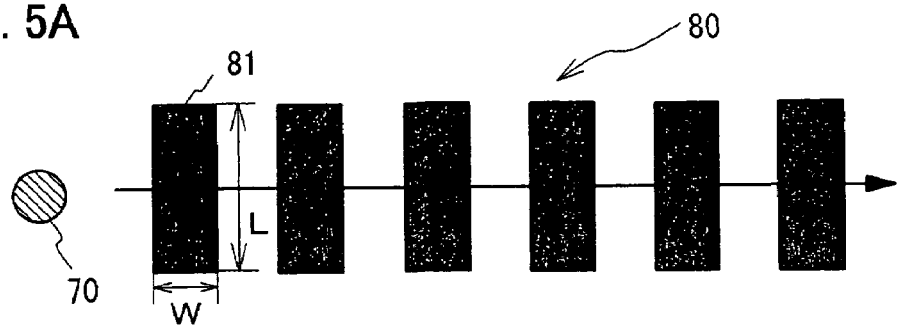
FIG. 5A is a view showing a displacement detection pattern formed on a recording paper sheet and a beam spot of light emitted to the recording paper sheet from the light emitting device by the displacement detection sensor.
Figure 5B:
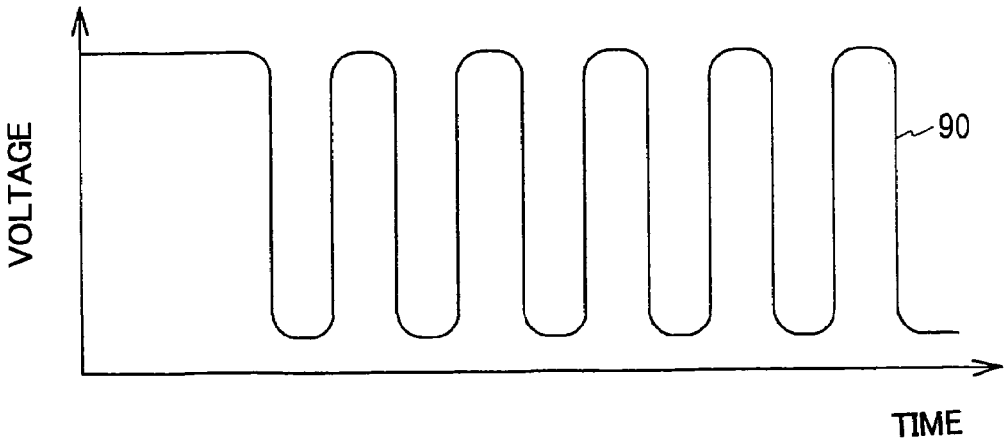
FIG. 5B is a view showing a signal output from a light receiving device.
Figure 6:
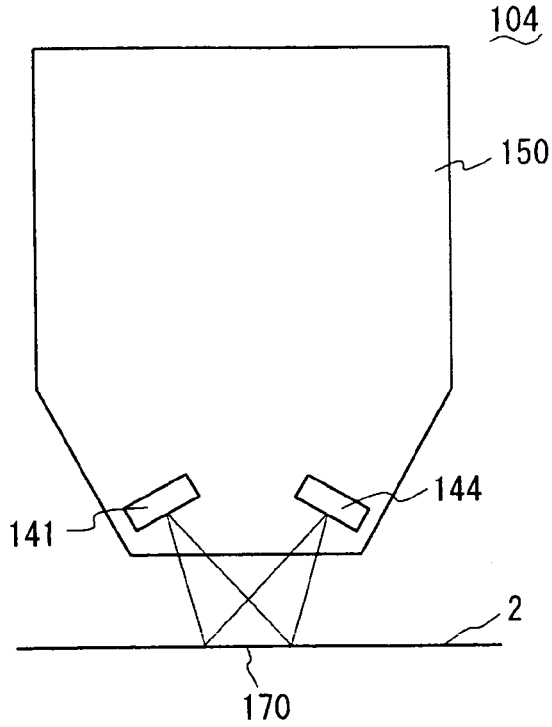
FIG. 6 is a view showing a configuration of a displacement detection sensor used in a conventional printer and a state where a displacement of printing position is detected by the sensor.
Figure 7A:
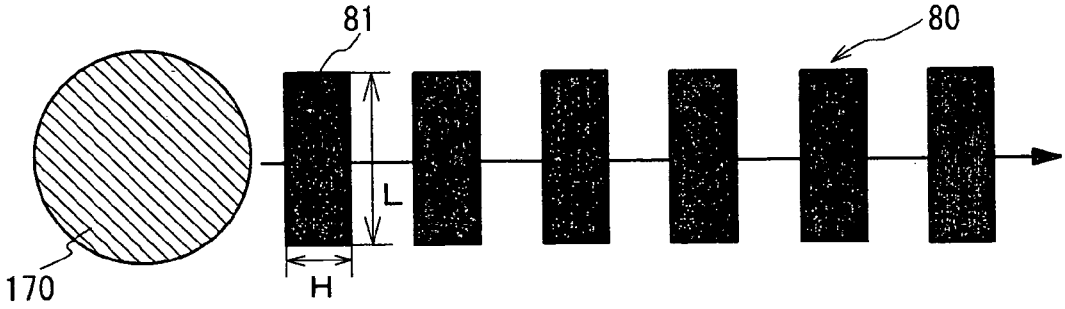
FIG. 7A is a view showing a displacement detection pattern formed on a recording paper sheet and a beam spot of light emitted to the recording paper sheet from the light emitting device by the conventional displacement detection sensor.
Figure 7B:
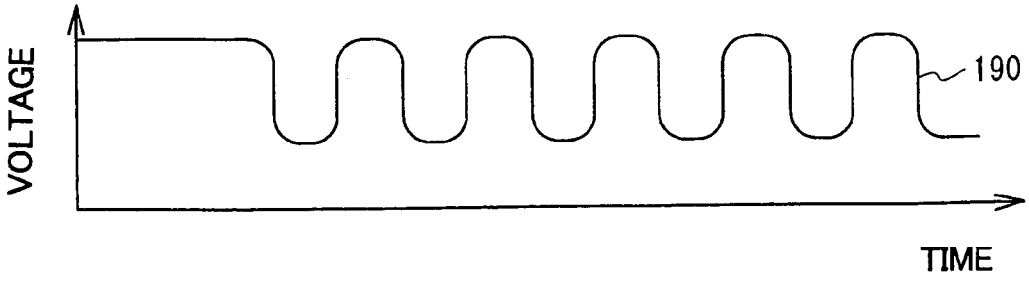
FIG. 7B is a view showing a signal output from a light receiving device of the conventional displacement detection sensor.

FIG. 4 shows a state where the displacement detection sensor 4 detects a displacement of printing position. FIG. 5A shows a displacement detection pattern formed on the recording paper sheet 2 and a beam spot of light projected on the recording paper sheet from the light emitting device. FIG. 5B shows output voltage of the light receiving device. In this embodiment, as shown in FIG. 4, the diffused light emitted from the light emitting device 41 is focused on the recording paper sheet 2 by the first lens 42 and the light emitting device 41 and the first lens 42 are arranged at proper positions according to their specifications. In this manner, as shown in FIG. 5A, a diameter of a beam spot 70 projected on the recording paper sheet 2 can be made smaller than a longitudinal dimension L and a width dimension H of each component 81 forming the displacement detection pattern 80. Thus, as shown in FIG. 5B, an electric signal 90 of a waveform with high amplitude, that is, a high S/N is output from the light receiving device 44, an edge of the displacement detection pattern 80 can be detected more accurately and the detection accuracy of the displacement detection sensor 4 can be improved.

More specifically, as for the first lens 42 and the second lens 43, resin molded lenses according to the same standard are used. A focal length F of each lens is about 5 mm, for example. The first lens 42 at the side of the light emitting device 41 is disposed closer to the recording paper sheet 2 as much as possible. On the contrary, the light emitting device 41 is kept away from the first lens 42 in the sensor housing 50 as much as possible. Thus, an incident angle of the light that enters into the first lens 42 from the light emitting device 41 becomes smaller, thereby making the diameter of the beam spot 70 irradiated on the recording paper sheet 2 smaller. Similarly, the second lens 43 at the side of the light receiving device 44 is disposed closer to the light receiving device 44 and the light receiving device 44 is kept away from the recording paper sheet 2 in the sensor housing 50 as much as possible. Thus, a change in a signal output from the light receiving device 44 becomes sharp, thereby making S/N higher. Furthermore, since the depth of field of the second lens 43 at the side of the light receiving device 44 becomes deeper, an influence of change in the distance between the light emitting device 41 and the light receiving device 44, and the recording paper sheet 2 due to unevenness of the recording paper sheet 2 can be reduced.

As described above, according to the ink jet printer 1 in this embodiment, the diffused light emitted from the light emitting device 41 is focused by the first lens 42, so that the diameter of the beam spot 70 projected on the recording paper sheet 2 can be made smaller and the beam spot can be made brighter. Moreover, the light reflected by the recording paper sheet 2 is focused on the light receiving device 44, so that the light receiving efficiency of the light receiving device 44 can be improved. Thus, the amplitude of the electric signal 90 output from the light receiving device 44 can be made larger and the detection accuracy of the displacement detection sensor 4 can be improved so as to adequately address high-resolution printing satisfactory to the user. Furthermore, since the detection accuracy of the displacement detection sensor 4 is improved by using the inexpensive lenses 42 and 43 instead of expensive light receiving devices with a slit, manufacturing costs of the overall printer can be reduced. Moreover, since the diameter of the beam spot 70 projected on the recording paper sheet 2 is set to be smaller than the longitudinal dimension L and the width dimension W of each component 81 forming the displacement detection pattern 80, the resolution of the displacement detection sensor 4 can be improved greatly and an edge of the displacement detection pattern 80 can be detected more accurately. Still furthermore, since light is focused by the first lens 42 and the second lens 43, the ratio of light which reaches to the light receiving device 44 against the light output from light emitting device 41 becomes higher. Thus, the inexpensive low-powered light emitting device 41 can be used, resulting in further cost reduction.

The present invention is not limited to the configuration of the above-mentioned embodiment and can be modified variously. For example, components forming the displacement detection sensor 4 include, but not limited to, the light emitting device 41, the first lens 42, the second lens 43, the light receiving device 44, the circuit board 45, the cover member 46, the metal plate 47 and the sensor housing 50, and other components may be properly added or omitted. The position and shape of the sensor housing 50 is not limited to that shown in FIG. 3 and any shape may be employed providing that the positional relationship between the recording paper sheet 2 and each component forming the displacement detection sensor 4 is ensured.

The ink jet printer according to the present invention only needs to have an ink cartridge having an ink tank for storing ink therein and a recording head for ejecting the ink stored in the ink tank as ink drops and forming an image on a recording paper sheet, a carriage on which the ink cartridge is attached, a driving mechanism for driving the carriage so as to move reciprocally in a direction substantially perpendicular to a direction for conveying the recording paper sheet, a displacement detection sensor for reading a predetermined displacement detection pattern formed on the recording paper sheet by the recording head, and a displacement correction control means for correcting a displacement of printing position by controlling ejection timing of ink drops from the recording head based on a result of reading the displacement detection pattern by the displacement detection sensor.

The displacement detection sensor has a light emitting device for emitting diffused light, a light receiving device for receiving the light emitted from the light emitting device and reflected by the recording paper sheet, converting the light into an electric signal and outputting the electric signal to the displacement correction control means, a circuit board to which terminals of the light emitting device and the light receiving device are connected, a cover member formed by resin molding for covering the circuit board, an antistatic metal plate attached to the outside of the cover member, a first lens for focusing the diffused light emitted from the light emitting device on the recording paper sheet, a second lens for focusing the light reflected by the recording paper sheet on the light receiving device and a sensor housing for accommodating the light emitting device, the light receiving device, the circuit board, the cover member, the first lens and the second lens.

Furthermore, the diffused light emitted from the light emitting device is focused by the first lens and reflected by the recording paper sheet, and then the diffused light is focused on the light receiving device by the second lens so that a diameter of a beam spot projected on the recording paper sheet is made smaller than a longitudinal dimension and a width dimension of each component forming a displacement detection pattern.

According to such a configuration, since the diffused light emitted from the light emitting device is focused by the first lens, the diameter of the beam spot projected on the recording paper sheet can be made smaller and the beam spot can be made brighter. Furthermore, since the light reflected by the recording paper sheet is focused on the light receiving device by the second lens, the light receiving efficiency of the light receiving device can be improved. Thus, the amplitude of an electric signal output from the light receiving device can be made larger and the detection accuracy of the displacement detection sensor can be improved so as to adequately address high-resolution printing satisfactory to the user. Still furthermore, since the detection accuracy of the displacement detection sensor is improved by using the inexpensive lenses instead of expensive light receiving devices with a slit, manufacturing costs of the overall printer can be reduced. Still furthermore, since the diameter of the beam spot projected on the recording paper sheet is set to be smaller than the longitudinal dimension and the width dimension of each component forming the displacement detection pattern, the resolution of the displacement detection sensor can be improved greatly and an edge of the displacement detection pattern can be detected more accurately. Still furthermore, since light is focused by the first lens and the second lens, the ratio of the light which reaches to the light receiving device against the light output from light emitting device becomes higher. Thus, the inexpensive low-powered light emitting device can be used, resulting in further cost reduction.

This application is based on Japanese patent application 2004-318515 filed Nov. 1, 2004 in Japan, the contents of which are hereby incorporated by references.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. An ink jet printer comprising:

an ink tank for storing ink therein and a recording head for ejecting the ink stored in the ink tank as ink drops and forming an image on a recording paper sheet;

a carriage on which the ink tank is attached;

a driving mechanism for driving the carriage so as to move reciprocally in a direction substantially perpendicular to a direction for conveying the recording paper sheet;

a displacement detection sensor for reading a predetermined displacement detection pattern formed on the recording paper sheet by the recording head; and a displacement correction control means for correcting a displacement of printing position by controlling ejection timing of the ink drops from the recording head based on a result of reading the displacement detection pattern by the displacement detection sensor; wherein the displacement detection sensor has:

a light emitting device for emitting diffused light;

a light receiving device for receiving the light emitted from the light emitting device and reflected by the recording paper sheet, converting the received light into an electric signal and outputting the electric signal to the displacement correction control means;

a first lens for focusing the diffused light emitted from the light emitting device on the recording paper sheet; and a second lens for focusing the light reflected by the recording paper sheet on the light receiving device; and in the displacement detection sensor, the diffused light emitted from the light emitting device is focused by the first lens and reflected by the recording paper sheet, and then the diffused light is focused on the light receiving device by the second lens, wherein resin molded lenses according to a same standard are used for the first lens and the second lens, the first lens is disposed closer to the recording paper sheet than the second lens, and an optical axis of the first lens and an optical axis of the second lens are symmetrical with respect to a normal that is perpendicular to the recording paper sheet.

2. An ink jet printer comprising:

an ink cartridge having an ink tank for storing ink therein and a recording head for ejecting the ink stored in the ink tank as ink drops and forming an image on a recording paper sheet;

a carriage on which the ink cartridge is attached;

a driving mechanism for driving the carriage so as to move reciprocally in a direction substantially perpendicular to a direction for conveying the recording paper sheet;

a displacement detection sensor for reading a predetermined displacement detection pattern formed on the recording paper sheet by the recording head; and a displacement correction control means for correcting a displacement of printing position by controlling ejection timing of the ink drops from the recording head based on a result of reading the displacement detection pattern by the displacement detection sensor; wherein the displacement detection sensor has:

a light emitting device for emitting diffused light;

a light receiving device for receiving the light emitted from the light emitting device and reflected by the recording paper sheet, converting the received light into an electric signal and outputting the electric signal to the displacement correction control means;

a circuit board to which terminals of the light emitting device and the light receiving device are connected;

a cover member formed by resin molding for covering the circuit board;

an antistatic metal plate attached to the outside of the cover member;

a first lens for focusing the diffused light emitted from the light emitting device on the recording paper sheet;

a second lens for focusing the light reflected by the recording paper sheet on the light receiving device; and a sensor housing for accommodating the light emitting device, the light receiving device, the circuit board, the cover member, the first lens and the second lens; and the diffused light emitted from the light emitting device is focused by the first lens and reflected by the recording paper sheet, and then the diffused light is focused on the light receiving device by the second lens so that the diameter of a beam spot projected on the recording paper sheet is made smaller than a longitudinal dimension and a width dimension of each component forming the displacement detection pattern, thereby making the amplitude of an electric signal output from the light receiving device larger to improve the detection accuracy of the displacement detection sensor.

3. The ink jet printer in accordance with claim 2, wherein as for the first lens and the second lens, resin molded lenses according to a same standard are used; and the first lens is disposed closer to the recording paper sheet than the second lens.

* * * * *